US005238074A

United States Patent [19]

Tibbitts et al.

[11] Patent Number: 5,238,074

[45] Date of Patent: Aug. 24, 1993

[54] MOSAIC DIAMOND DRAG BIT CUTTER HAVING A NONUNIFORM WEAR PATTERN

[75] Inventors: Gordon A. Tibbitts, Salt Lake City, Utah; Kenneth Johns, Singapore, Singapore

[73] Assignee: Baker Hughes Incorporated, Houston, Tex.

[21] Appl. No.: 817,861

[22] Filed: Jan. 6, 1992

[51] Int. Cl.[5] ..... E21B 10/46

[52] U.S. Cl. ..... 175/428

[58] Field of Search ..... 174/374, 383, 405.1, 174/425, 434, 428, 430, 426, 432, 431, 296, 393, 420.1, 421

[56] References Cited

U.S. PATENT DOCUMENTS

| | | | |
|---|---|---|---|
| 3,294,186 | 12/1966 | Buell | 175/420.1 |
| 3,298,451 | 1/1967 | Eckel et al. | 175/421 |
| 3,440,773 | 4/1969 | Hawkes | 51/206 |
| 3,882,749 | 5/1975 | Tourek | 83/651 |
| 3,941,196 | 3/1976 | Curington et al. | 175/100 |
| 4,128,136 | 12/1978 | Generoux | 175/405.1 |
| 4,252,102 | 2/1981 | Phaal et al. | 125/39 |
| 4,255,165 | 3/1981 | Dennis et al. | 51/309 |
| 4,351,401 | 9/1982 | Fielder | 175/329 |
| 4,440,246 | 4/1984 | Jurgens | 175/329 |
| 4,441,566 | 4/1984 | Pessier et al. | 175/374 |
| 4,592,433 | 6/1986 | Dennis | 175/329 |
| 4,604,106 | 8/1986 | Hall et al. | 51/293 |
| 4,629,373 | 12/1986 | Hall | 175/434 |
| 4,726,718 | 2/1988 | Meskin et al. | 408/145 |
| 4,744,427 | 5/1988 | Grappendorf | 175/329 |
| 4,943,488 | 7/1990 | Sung et al. | 428/552 |
| 5,025,873 | 6/1991 | Cerkovnik | 175/329 |
| 5,025,875 | 6/1991 | Witt | 175/393 |
| 5,027,912 | 7/1991 | Joergens | 175/329 |
| 5,028,177 | 7/1991 | Meskin et al. | 175/403 |
| 5,103,922 | 4/1992 | Jones | 175/421 |
| 5,135,061 | 8/1992 | Newton, Jr. | 175/428 |
| 5,154,245 | 10/1992 | Waldenström | 175/420 |

OTHER PUBLICATIONS

Color photograph showing a "bear claw" cutter.

Eastman Christensen Company *Bit Style Book* 1988.

*Primary Examiner*—Ramon S. Britts

*Assistant Examiner*—Frank S. Tsay

*Attorney, Agent, or Firm*—Marger, Johnson, McCollom & Stolowitz

[57] ABSTRACT

A cutter for a rotating drag bit which has a cutting face formed from a plurality of polycrystalline diamond compact (PCD) elements. The elements can be of varying thickness and/or varying hardness to provide a cutting edge having a nonuniform wear pattern. Also provided is a cutter which includes two layers of PCD elements. The PCD elements can be of varying thickness and/or hardness to provide a cutter which presents a cutting edge having a wear ratio which varies with cutter wear. Also provided is an impact cutter having a cutting surface formed from one or more layers of PCD elements.

38 Claims, 5 Drawing Sheets

MOSAIC DIAMOND DRAG BIT CUTTER HAVING A NONUNIFORM WEAR PATTERN

BACKGROUND OF THE INVENTION

1. Field of the Invention

The present invention relates generally to mosaic diamond drill bit cutters of the type incorporating polycrystalline and thermally stable diamond products and more particularly to such a cutter which forms a nonuniform wear pattern during drilling. In another aspect, the invention relates to drill bits incorporating cutters which wear at different rates.

2. Description of the Related Art

One type of cutter for an earth-boring rotary drag bit is made from a plurality of polycrystalline diamond (PCD) cutting elements. The PCD cutting elements are embedded in a metal matrix having a planar cutting face. Each of the PCD elements has a planar end surface which is coplanar with the cutting face. The cutting face therefore comprises both matrix material and PCD material. During drilling, cutting occurs along a cutting edge defined by one side of the cutting face. The cutting edge is embedded partly into the rock formation and is advanced therethrough by bit rotation. During drilling, the matrix and the PCD elements therein gradually wear from the cutting edge into the matrix.

One such prior art cutter is disclosed in U.S. Pat. No. 4,726,718 to Meskin et al. for a multi-component cutting element using triangular, rectangular and higher order polyhedral-shaped polycrystalline diamond disks. The Meskin et al. cutter includes triangular PCD elements embedded in a metal matrix having a diamond grit dispersed therein.

U.S. Pat. No. 4,592,433 to Dennis discloses a cutting blank with diamond strips in grooves. In Dennis, PCD material in different shapes, including strips and chevrons, has a planar surface exposed on the cutting surface of a cutting blank. The metal cutting blank in which the PCD elements are embedded produces an irregular cutting edge as the cutting blank does not cut the formation but wears away at a much faster rate than the PCD cutting elements. U.S. Pat. No. 4,255,165 to Dennis et al. discloses a composite compact of interleaved polycrystalline particles and cemented carbide masses in which cemented carbide is interleaved with PCD material. During cutting the carbide rapidly wears away leaving the PCD cutting elements exposed in a so-called bear claw configuration in which the PCD cutting elements form spaced cutting fingers. The prior art cutters present a jagged or irregular cutting edge which in some circumstances cuts more effectively than a smooth or uniform cutting edge.

As used herein, the term wear ratio refers to the volume of a cutting element worn away relative to the volume of rock worn away during an abrasive cutting test. Such cutting tests are known in the art to which the present invention relates and involve abrading the surface of a preselected rock with a cutting element of interest. For PCD or thermally stable diamond products, the wear ratio is a function of several parameters, including diamond feedstock size, degree and type of sintering, force applied, grain size, cementation of rock and temperature. As used herein, the term wear rate refers to the rate at which a cutting element wears during drilling. The wear rate is a function of the wear ratio of the wear rate and geometry of the cutting element. Thus, cutting elements having the same wear ratio but different geometries wear at different rates. Similarly, cutting elements with the same geometry but with different wear ratios also wear at different rates.

Although the prior art PCD cutters described above produce irregular patterns on a cutting edge during wear, none incorporates a cutting edge which wears at different rates along the edge. Prior art cutters include irregularly shaped PCD material embedded in a matrix; however, the PCD elements which form the cutting edge have a uniform wear rate. While some of the prior art patents include PCD material alternating with carbide along a cutting edge, the carbide does not cut but rather simply wears away thereby leaving an irregularly shaped cutting edge but still with cutting elements all of which have a uniform wear rate. It would be desirable to provide a cutter having a cutting edge which includes cutting elements that wear at different rates to present an irregular cutting edge.

None of the prior art cutters wear at different rates. It would be desirable to have such a cutter to permit cutting with elements having a first wear rate through an initial formation having one hardness and thereafter boring through a lower formation through which it would be desirable to cut with a cutter having a different wear rate. Because the prior art cutters are made of PCD cutting elements having only a single wear rate, the wear rate of the cutting elements remains the same while the hardness of the formation through which the bit is drilling may vary. It would be desireable to provide a drill bit with cutters having a wear rate which varies in a preselected fashion to optimize cutting through formations of varying hardness.

It would also be desireable to provide a cutter which presents an increased surface area of PCD cutting elements toward the bottom of the bore hole thereby slowing wear rate of the cutting edge.

It would also be desireable to provide the same advantages as described above in connection with a rotary drag bit in a percussive drill bit.

It would be desirable also to implement such a cutter which is mounted in any fashion including bits of the type in which the cutters are integrally formed with the bit body as well as on bits of the type having stud-mounted cutters or cutters brazed to the bit body.

As discussed above, none of the prior art discloses a cutter for a rotating drag bit having PCD cutting elements which wear at different rates. Moreover, none of the prior art discloses a rotating drag bit having cutters formed of diamond cutting elements in which the cutting elements on one cutter wear at a different rate from the cutting elements on another cutter. It would be desireable to provide such a rotating drag bit in which, e.g., the cutters arranged in one blade on the bit include diamond elements having a first wear rate while cutters in another blade on the bit have a different wear rate. Such a drill bit would permit concentration of cutting action on only a few blades having a relatively low wear rate while additional blades, having a relatively high wear rate, stabilize the bit during drilling.

SUMMARY OF THE INVENTION

The present invention comprises a diamond cutter in a rotating drag bit including a cutting face. A first group of cutting elements each having at least one end surface and being subject to wear at a first rate are disposed in a cutting slug formed of matrix material. A second group of cutting elements each having at least one end surface and being subject to wear at a second rate different from the first rate are also disposed in the cutting slug. A cutting face is defined by a plurality of cutting element end surfaces exposed on the cutting face. The face forms a surface which may be of any shape including planar, wavy or hemispherical.

In another aspect of the invention, a rotating drag bit comprises cutters formed from PCD cutting elements in which one of the cutters has cutting elements which wear at a first rate and another of the cutting elements which wear at a second rate different from the first rate.

In still another aspect of the invention, a percussive drill bit and method of percussive drilling utilizes a bit body having a working surface profile of a type suitable for percussive drilling. One or more layers of PCD cutting elements on the bit are provided which are compressed each time the cutting element strikes a formation during drilling.

DETAILED DESCRIPTION OF THE PREFERRED EMBODIMENTS

Figure 1:
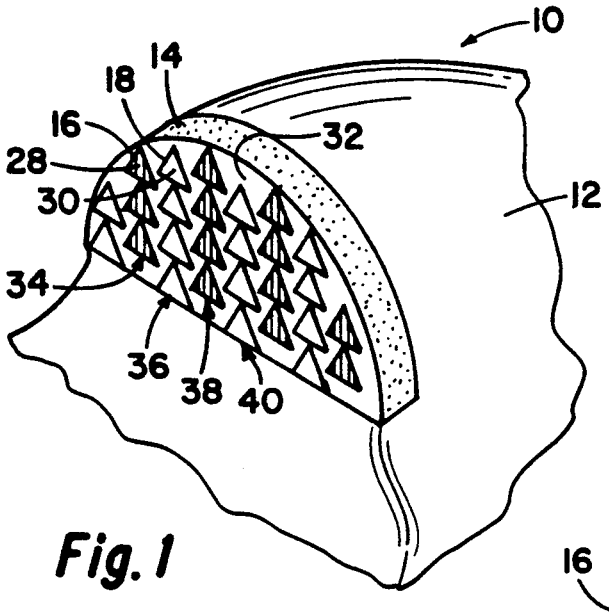
FIG. 1 is a diagrammatic perspective view of a first embodiment of the invention.

Turning now to the drawings and with reference to FIG. 1, indicated generally at 10 is a cutter constructed in accordance with the present invention. In the present embodiment of the invention, cutter 10 is formed on an infiltrated matrix bit body 12. It is to be appreciated that the present invention can be equally well implemented in a drill bit having a body which is cast or otherwise formed and can be implemented on a cutter mounted on a stud or on a drill bit of the type in which the cutters are brazed to a bit body. Cutter 10 includes a cutting slug 14 in which a plurality of polycrystalline diamond (PCD) cutting elements, two of which are elements 16, 18, are disposed. The cutting elements are leached using a known process to increase the resistance of the cutting elements to heat. Cutting slug 14 can be formed by a variety of methods, such as conventional hotpress techniques or by infiltration techniques separately from the matrix body or may be formed simultaneously through infiltration techniques with the bit body. Both techniques for forming the cutting slug are known in the art.

Figure 12:
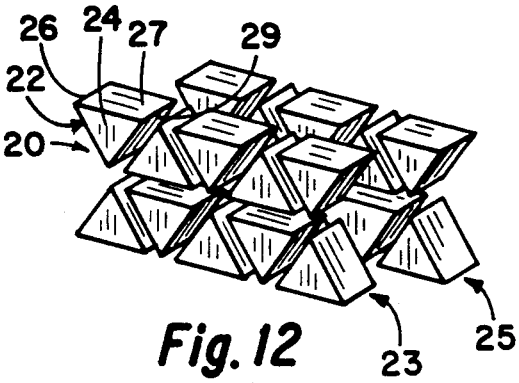
FIGS. 12, 15, 16, 17A and 17B are diagrammatic perspective views of the arrangement of PCD cutting elements in additional embodiments of the invention.

Turning briefly to FIG. 12, indicated generally at 20 is a portion of a cutter including a PCD cutting element 22. Three square sides, two of which are sides 27, 29, and a third (not visible) define the sides of PCD element 22. FIG. 12 illustrates the position of a plurality of PCD elements held within a cutting slug, which is not shown to reveal the geometry and relative positions of the PCD cutting elements. PCD cutting element 22 is substantially identical in shape and size to PCD cutting elements 16, 18. Element 22 further includes an end surface 24 which is coplanar with the end surfaces of a number of the other cutting elements. End surface 24 and the other PCD element end surfaces coplanar therewith define a portion of a cutting face. Cutting element 22 includes an edge 26 which extends into the cutting slug from the cutting face and which defines the thickness of cutting element 22. In the embodiment of FIG. 12, the cutting elements are arranged in two parallel layers 23, 25.

Returning again to FIG. 1, each of cutting elements 16, 18 also include a planar end surface 28, 30, respectively. The exposed end surfaces of each of the cutting elements in cutting slug 14, along with a coplanar surface 32 of the cutting slug, define the cutting face of cutter 10. Although not visible in FIG. 1, each of the PCD cutting elements has a preselected thickness which determines the depth to which each cutting element extends into cutting slug 14 from surface 32.

The cutting elements of cutter 10 are arranged in rows, four of which are rows 34, 36, 38, 40. The cutting elements in rows 34, 38 are made of PCD material having a first hardness while the cutting elements in rows 36, 40 are made of a PCD material having a second lower hardness. In the cutter of FIG. 1, the PCD elements in alternate rows, like rows 34, 38, are made up of PCD elements having a first hardness. PCD elements in the interleaved rows, like rows 36,40, are made up of PCD elements having a second lower hardness. In FIG. 1, the elements having the first hardness are marked with vertical parallel lines (only to provide a visual indication of which elements have the first hardness) while the elements having the second lower hardness are unmarked.

Figure 2:
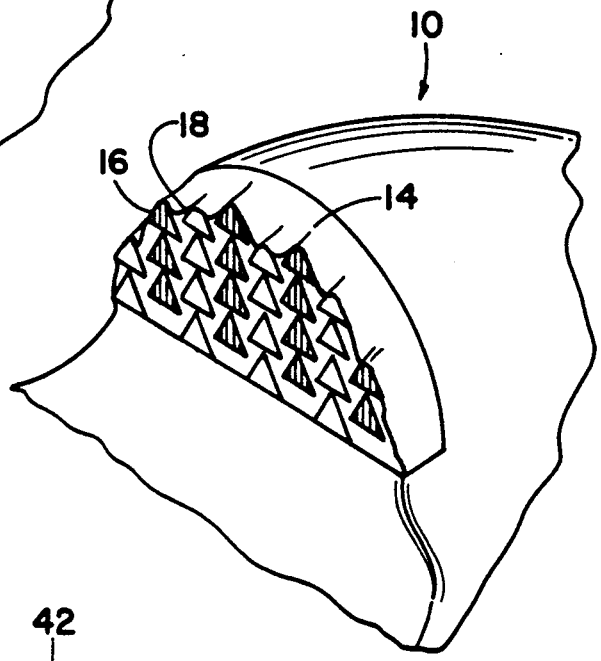
FIG. 2 is a view similar to FIG. 1 illustrating the embodiment of FIG. 1 after wear caused by drilling.

During drilling, the cutting edge wears. As viewed in FIG. 1, the cutting edge comprises which comprises the generally upper portion of cutting slug 14. Such wear is illustrated in FIG. 2. It can be seen that the matrix material from which cutting slug 14 is formed wears very rapidly while the cutting elements having a second lower hardness, like cutting element 18, wear less rapidly. The cutting elements with the first hardness, like cutting element 16, wear least rapidly of all. A nonuniform cutting edge, like that shown in FIG. 2 is thus presented. Under certain conditions, which are known in the art, such a nonuniform cutting edge enhances cutting action of the cutter as contrasted with a cutter having a curvilinear edge.

Figure 3:
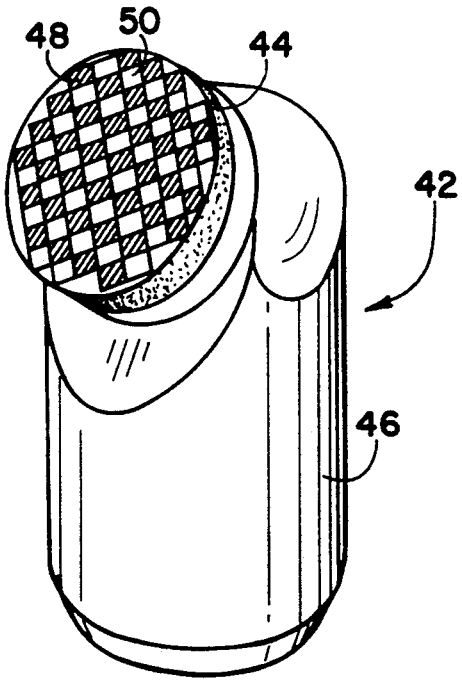
FIG. 3 is a diagrammatic perspective view of a second embodiment of the invention.

Indicated generally at 42 in FIG. 3 is a cutter 42 also constructed in accordance with the present invention. Cutter 42 includes cutting slug 44 bonded to a steel or tungsten carbide stud 46. Cutting slug 44, like cutting slug 14 in FIGS. 1 and 2, comprises an array of a plurality of synthetic PCD elements, like elements 48, 50. As with the embodiments of FIGS. 1 and 2, cutting slug 44 may be separately formed by conventional hot-press techniques or by infiltration techniques separately from the bit body matrix or may be formed simultaneously therewith through infiltration techniques with the bit body.

Also as in the embodiment of FIGS. 1 and 2, and as used throughout, the cutting elements having vertical lines thereon are made from PCD material which more hard than the PCD material from which the unmarked cutting elements are made. It should be noted that techniques for producing PCD cutting elements of different shapes and hardness are well known in the art. The cutting elements of FIG. 3 will wear in a manner which produces an irregular cutting edge.

Figure 4:
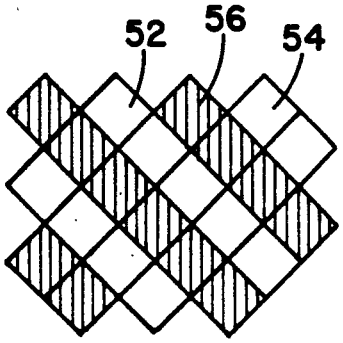
FIGS. 4–8 are diagrammatic front elevation views of a cutter cutting face constructed in accordance with the present invention.

In FIG. 4, a portion of a cutting face 52 formed on a cutter includes PCD elements having two wear ratios, one of which is cutting element 54 and another of which is cutting element 56, arranged in alternate rows as shown. Like the previously described embodiment, during drilling, wear creates an irregular cutting edge on the cutter upon which cutting face 52 is formed.

Figure 5:
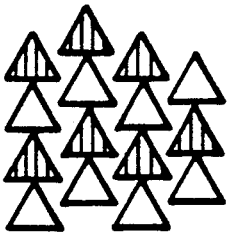
Figure 6:
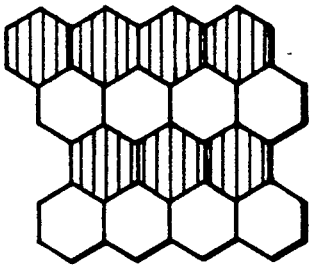
Figure 7:
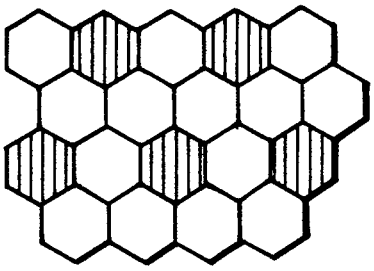

FIGS. 5, 6 and 7 all illustrate views similar to FIG. 4 but with cutting elements having triangular shapes, in FIG. 5, and hexagonal shapes in FIGS. 6 and 7. It should be noted that the embodiments of FIGS. 5 and 6 incorporate cutting elements having different wear ratios in alternate horizontal rows rather than in alternate vertical rows as in the embodiment of FIGS. 1 and 2. Thus, during cutting, the cutting edge comprises a generally nonuniform shape, due to the triangular configuration of cutting elements in FIG. 5 and the hexagonal shape in FIG. 6, having substantially uniform wear ratios. As cutting proceeds, wearing away the elements a row at a time, the cutting edge alternates between having cutting elements made up of one wear ratio and cutting elements made up of another. Thus, when the geology of a formation having alternate layers of rock which vary in hardness is known, a cutter can be selected which presents a cutting edge having the appropriate wear ratio for each layer of the formation through which it cuts.

Figure 8:
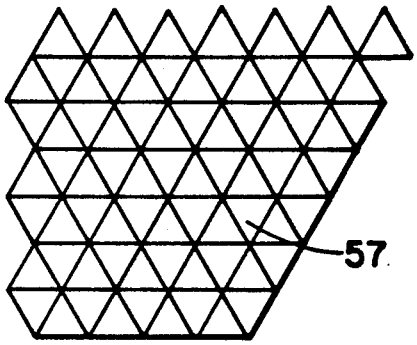
Figure 9A:
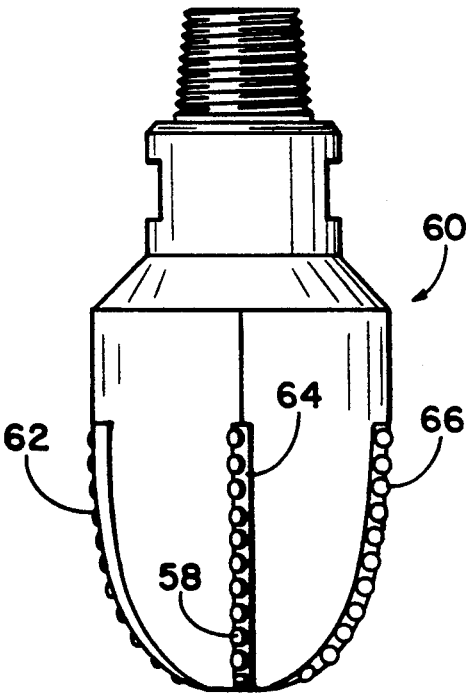
FIG. 9A is a front elevation of a rotating drag bit constructed in accordance with the present invention.
Figure 9B:
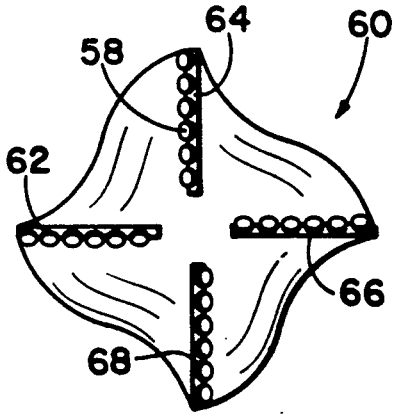
FIG. 9B is a bottom plan view of the drill bit of FIG. 9A.

FIG. 8 illustrates a cutting face 57 made up of PCD cutting elements having a substantially uniform wear ratio. Cutting face 57 is formed on a cutter 58, in FIGS. 9A and 9B, which is mounted on a drill bit 60. In drill bit 60, a plurality of cutters are arranged in four blades 62, 64, 66, 68. The cutters on blades 64, 68, like cutter 58, are made from PCD material which has a wear ratio resulting in faster wear than the wear ratio of the cutters on blade 62, 66 are made. As is the case with blades 64, 68, the cutters on blades 62, 66 are made from PCD material having a single wear ratio.

During drilling with bit 60, the weight of the bit is primarily on the hard cutters, i.e., those in blades 62, 66, while the relatively faster-wearing cutters in blades 64, 68 serve to stabilize bit rotation. Thus, the rapid penetration of a two-bladed bit is obtained with a four-bladed bit, which provides increased stability over that normally exhibited in a two-bladed bit.

Figure 10:
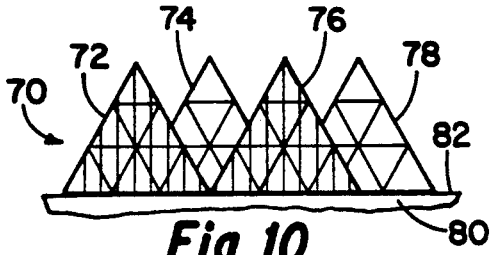
FIG. 10 is a diagrammatic view of the arrangement of four cutting elements on a bit crown.
Figure 11:
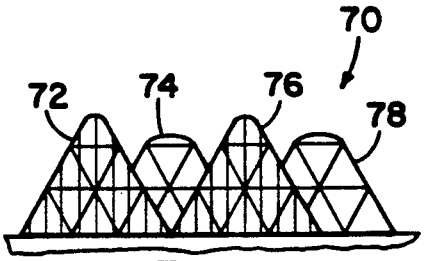
FIG. 11 is a diagrammatic view similar to FIG. 10 after wear caused by drilling.

Turning now to FIG. 10, illustrated generally at 70 is a portion of a drill bit having cutters, four of which are cutters 72, 74, 76, 78, mounted thereon. Bit 70 includes a bit body 80 and an exterior surface or crown 82 upon which the cutters are mounted. Cutters 72, 76 are each made up of PCD material having a low wear ratio, which tends to resist wear more so than material with a high wear ratio, while cutters 74, 78 are made up of material having a higher wear ratio. The cutters may be arranged in blades or may be in any configuration in which the cutters alternate between high and low wear ratio PCD cutting elements. FIG. 11 illustrates the wear which occurs after a period of drilling with bit 70. As can be seen cutters 74, 78 wear at a faster rate than cutters 72, 76. Such action creates adjacent cuts having different depths. Because of the differing depths of cut, at least some of the formation being cut is not laterally constrained and therefore can be cut more easily.

Turning now to FIG. 12, as previously described, FIG. 12 includes two layers 23, 25 of PCD elements. In the embodiment of FIG. 12, all of the PCD elements are of the same wear ratio. Each of the cutting elements, like element 22, includes a pair of opposed end faces, like end face 24, which is exposed on the cutting face of the cutter. Another end face (not visible) is also triangular in shape and is substantially parallel to end face 24. Each of the other PCD elements is similarly constructed. The arrangement of the elements is as shown in FIG. 12.

During drilling, the area of the diamond exposed to the side of the cutter having the cutting edge thereon is increased because of the addition of an extra layer, layer 25, of PCD elements. Because the wear rate of the cutting edge is proportional to the total surface area of PCD element exposed adjacent the cutting edge, wear is reduced.

Figure 13:
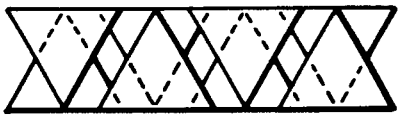
FIGS. 13 and 14 are plan elevation views of PCD cutting elements in additional embodiments of the invention.
Figure 14:
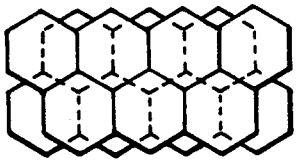
Figure 15:
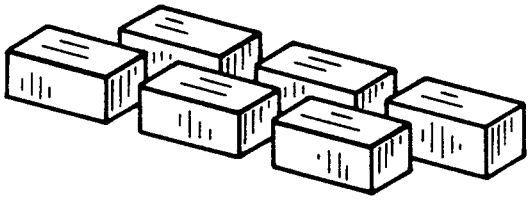
Figure 16:
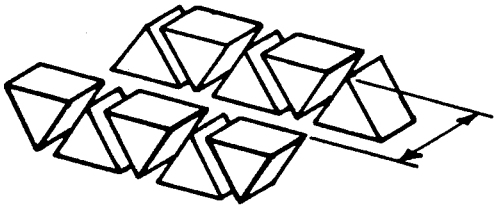

In FIG. 12, each of the PCD elements in layer 23 is aligned with a corresponding element in layer 25. FIGS. 13–15 illustrate different embodiments of a two-layer cutter in which the cutting elements are substantially identical in shape to one another but are offset laterally from one layer to the next. In the view of FIG. 16, the first and second layers are spaced laterally from one another in addition to being offset.

In the two-layer embodiments of FIGS. 12–16, each layer includes PCD elements all having substantially the same wear ratio. It should be noted however that it is contemplated to be within the scope of the invention to provide a first layer of PCD elements, each of which includes an end face coplanar with the cutting face of the cutter, having a first wear ratio and a second layer of PCD elements, behind the first layer as illustrated in the drawings, having a second different wear ratio. Thus, a cutter can be "tailored" for optimum cutting through a particular formation having adjacent layers of rock which have different wear ratio. A person having ordinary skill in the art, and knowledge of a particular formation, can select PCD elements in each layer having appropriate thickness and wear ratios so that as a first layer is being worn through at the cutting edge, the drill bit enters the next-downward rock layer in the formation. The next layer of PCD elements, which is optimized for the rock layer the bit is entering, is thus exposed to provide cutting action.

With reference again to FIG. 12, the same effect as described above when using PCD elements of one wear ratio in layer 23 and PCD elements of another wear ratio in layer 25 may be achieved in another manner. Instead of using PCD elements having different wear ratios in layers 23, 25, all of the elements have the substantially the same wear ratio; the thickness, however, of the elements in one layer is different from that of the other layer. For example, in FIG. 12, PCD element 22 in layer 23, rather than extending the length of edge 26 into the matrix (not shown for clarity) from the cutting surface thereof, extends only, e.g., one-half of the distance illustrated. Similarly, each of the other PCD elements in layer 23 are identical to PCD element 22, i.e., they are of a uniform thickness equal to one-half of the thickness of elements in row 25. Since the rate of wear is dependent upon the geometry of the PCD element being worn, the elements in layer 23 wear twice as fast as those in layer 25 thus exposing the layer 25 elements on the cutting edge after the elements in layer 23 are sufficiently worn. Thus, the same effect is achieved by using PCD elements having the same wear ratio but varying thicknesses when using PCD elements of uniform thickness and different wear ratios.

Consideration will now be given to use of variations in thickness of PCD elements to achieve an irregular or nonuniform cutting edge with reference to FIGS. 17A and 17B.

Figure 17A:
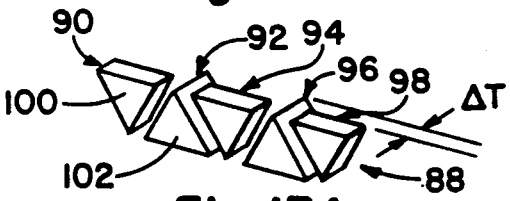

Indicated generally at 88 in FIG. 17A is a row of PCD elements 90, 92, 94, 96, 98. Each of the elements include an end face, like end faces 100, 102 in elements 90, 92, respectively. It is to be appreciated that row 88 is maintained in position in a cutter matrix which includes additional PCD elements (not shown) above and below row 88. All of the PCD elements have end faces, like end faces 100, 102, which are coplanar with each other and with a planar surface of the matrix which, together with the end faces, form the cutting face of the cutter.

It can be seen that alternate PCD elements are substantially indentical to one another with adjacent elements having different thickness. In the embodiment of 17A, element 90 is one-half as thick as element 92. Thus, during drilling, when the elements in row 88 are exposed on the cutting edge of the cutter, the relatively thin cutting elements, three of which are 90, 94, 98 wear at a different rate from that of the relatively thick elements. Moreover, in FIG. 17A, the orientation of the PCD elements initially exposes more surface area of the relatively thin elements to wear than that of the relatively thick elements. Thus, an irregular cutting edge which changes in shape during wear is presented.

Figure 17B:
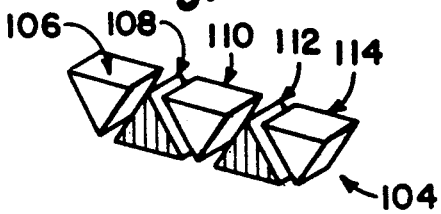

The same type of wear pattern as the cutter in FIG. 17A is created in the cutter of FIG. 17B in which a row of PCD elements is indicated generally at 104. Row 104 includes elements 106, 108, 110, 112, 114. As in previous embodiments, vertical lines on the end faces in the cutting surface indicate PCD elements with lower wear ratios than the PCD elements having unlined end faces. Thus, in the cutter of FIG. 17B, if the hard PCD elements 108, 112 are twice as hard as PCD elements 106, 110, 114, the same wear pattern when row 104 is in the cutting edge is created as when row 88 is in the cutting edge.

Figure 22:
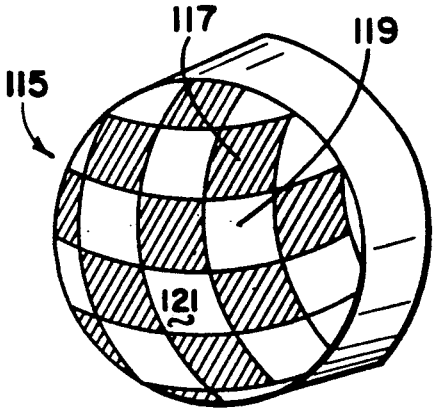
FIG. 22 is perspective view of a drill bit cutter constructed in accordance with the present invention.

Turning to FIG. 22, indicated generally at 115 is another embodiment of a cutter constructed in accordance with the present invention. Cutter 115 includes a plurality of cutting elements, like cutting elements 117, 119 each of which present an exposed end surface which defines a portion of a spherical surface 121 which forms the cutting face of cutter 115. As in the previously described embodiments variations in the geometry and wear ratio of the cutting elements which make up the cutter surface create an irregular cutting edge due to uneven rates of wear of the cutting elements.

Figure 24:
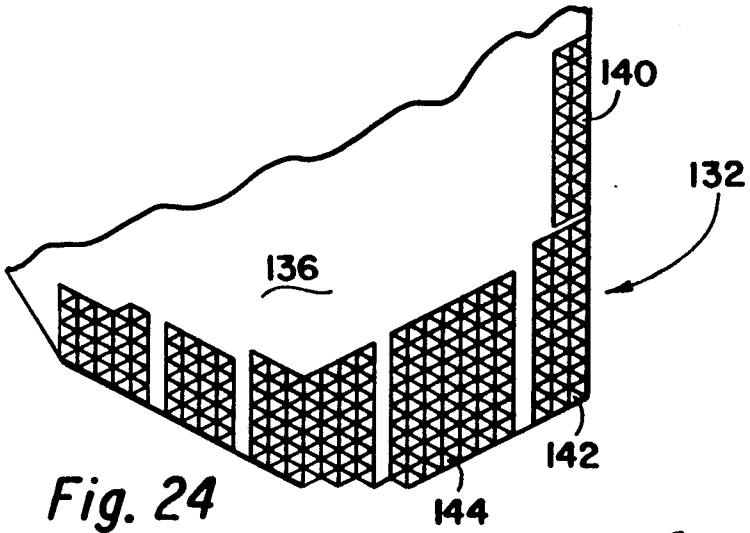
FIG. 24 is a partial enlarged front elevation view of the drill bit of FIG. 23 illustrating the mosaic pattern for the short blades on the bit.
Figure 25:
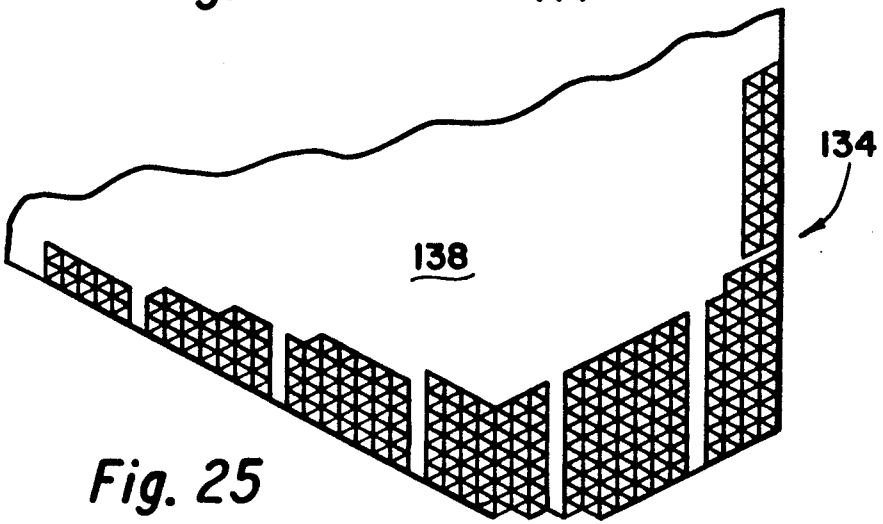
FIG. 25 is a partial enlarged front elevation view of the drill bit of FIG. 23 illustrating the mosaic pattern for the long blades on the bit.
Figure 23:
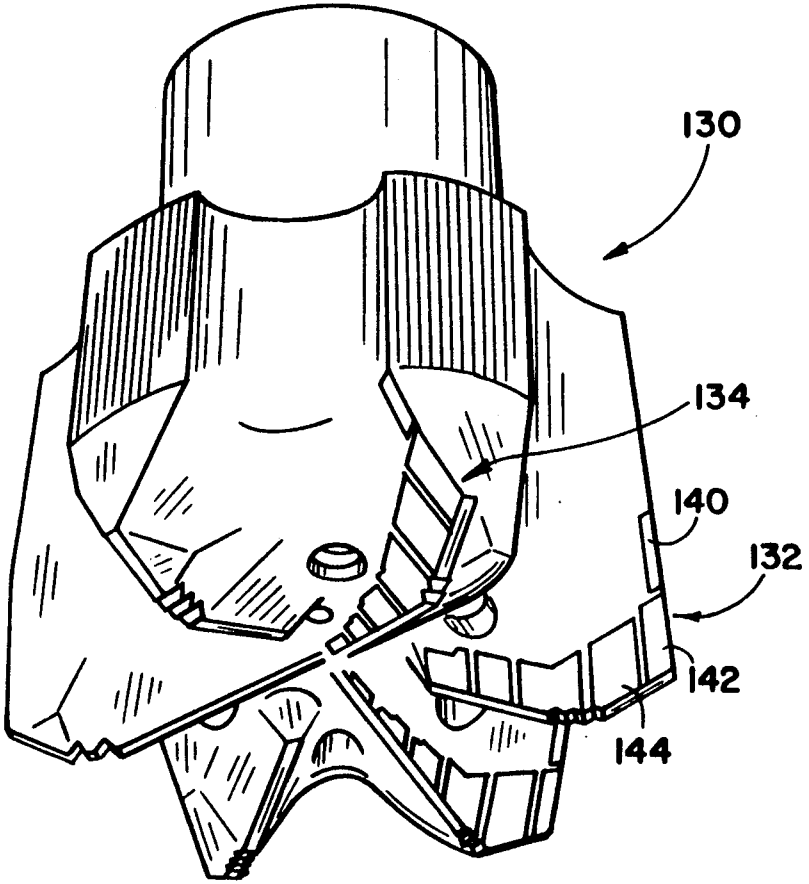
FIG. 23 is a perspective view of a bladed drill bit having mosaic cutting elements brazed to the drill bit body.

Indicated generally at 130 in FIG. 23 is a bladed drill bit. Bit 130 includes alternating short and long blades, like blades 132, 134, respectively. Each of the blades includes a planar surface 136, 138, in FIGS. 24 and 25, respectively, upon which a plurality of cutting elements, like those previously described herein, are mounted. The cutting elements are mounted on the planar surfaces in groups, like groups 140, 142, 144 are mounted on surface 136. Each of the groups are referred to herein as cutters although all of the cutting elements on each blade may also be considered to form a single large cutter. In drill bit 130, each of the cutting elements is triangular in shape. The variations in wear ratio and cutting element geometry previously described herein connection with cutting elements mounted on cutters may be equally well implemented in the cutting elements mounted on bit 130.

The bit 130 cutting elements are mounted on surfaces 136, 138 via brazing. As used herein, the term matrix material encompasses the materials used to braze the individual cutting elements to a drill bit surface, like the cutting elements on bit 130 are brazed to the planar surfaces like surfaces 136, 138. Known brazing methods may therefore be used both to mount cutters on a drill bit, as previously described herein, and to mount cutting elements on a bit, like the triangular cutting elements are mounted on surfaces 136, 138. The cutting elements need not be triangular in shape but can assume other configurations as described herein.

Figure 18:
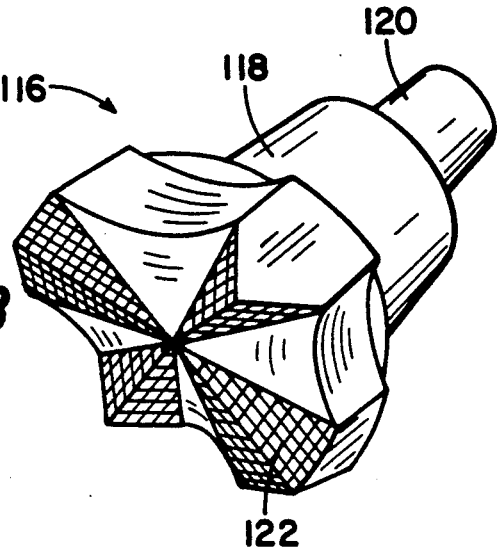
FIG. 18 is a perspective view of a percussive drill bit constructed in accordance with the present invention.

Turning now to FIG. 18 and indicated generally at 116 is a percussive drill bit constructed in accordance with the present invention. Bit 116 includes a bit body 118 and a shank 120 which is used to mount the bit on a conventional pneumatic or hydraulic hammer (not shown). Such a device typically vibrates with a small range of motion against the bottom of a hole being drilled. The bit includes an impact surface 122 which is made up of a plurality of PCD elements, two of which are elements 124, 126 in FIG. 19, which are bonded to or integrally formed with bit body 118 in a known manner. Alternatively, an abrasive diamond surface can be created on the bit body by chemical vapor deposition.

In operation, the PCD elements, like elements 124, 126, which form surface 122 are repeatedly impacted against the bottom of a hole being dug by the hammer upon which the bit is mounted. Each impact places the PCD elements in compression which they are particularly well suited to withstand. Additionally, the PCD surface exposed on surface 122 provides a good abrasion surface.

Figure 20:
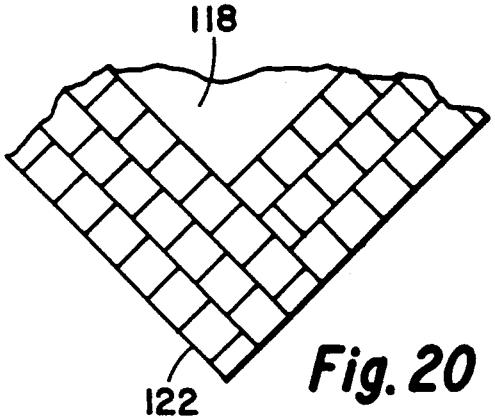
FIG. 20 is a partial sectional view similar to FIG. 19 of another percussive drill bit constructed in accordance with the invention.
Figure 21:
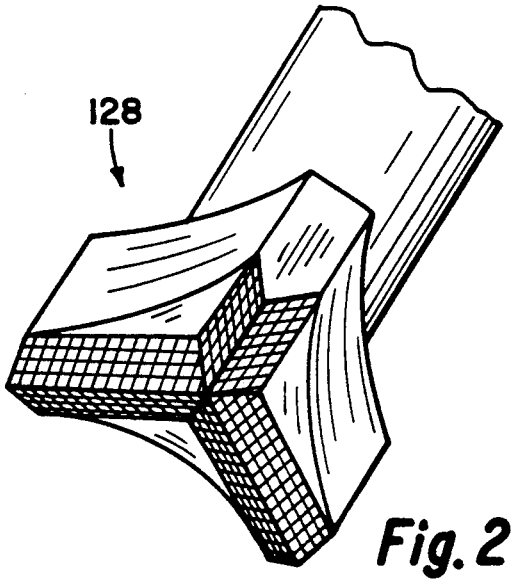
FIG. 21 is another perspective view of a percussive drill bit constructed in accordance with the present invention.

FIG. 20 illustrates a slightly modified embodiment of the invention in which the PCD elements are layered. As with previously described embodiments, the PCD elements may have different wear ratios and the element layers can be of varying thicknesses. In the FIG.

20 embodiment, there can also be spaces between the layers made of cutting elements of different hardness or thickness or of some other material.

Figure 19:
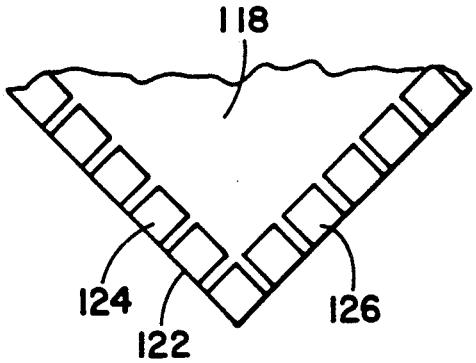
FIG. 19 is a partial sectional view of the embodiment of FIG. 18.

Indicated generally at 128 is another embodiment of a percussive drill bit constructed in accordance with the present invention which has a differently shaped bit body and which therefore presents an impact surface different from bit 116. As with bit 116, PCD elements are used to create the impact surface in bit 128 either in a single layer, as illustrated in FIG. 19 or in multiple layers as illustrated in FIG. 20.

It should be appreciated that in each of the described embodiments, the boundaries of the end face can take any geometric or irregular form. In addition, the cuter cutting face can be planar, hemispherical, wavy or any other shape. Also, the distribution of cutting elements with different wear ratios or thicknesses can be in a regular repeating pattern or may be random. A random arrangement for use in a formation in which the hardness varies may provide improved rates of penetration over a cutter in which there is a regular pattern.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

We claim:

1. A cutter in a rotating drag bit comprising:

a cutting face;

a first group of cutting elements each having at least one end surface and being subject to wear at a first rate, said end surfaces being exposed on said cutting face;

a second group of cutting elements each having at least one end surface and being subject to wear at a second rate different from said first rate, said second group end surfaces also being exposed on said cutting face; and a cutting slug formed of matrix material and having said first and second groups of cutting elements disposed therein, said cutting face being defined by a plurality of said end surfaces exposed on said cutting face.

2. The cutter of claim 1 wherein said elements in said first group are arranged in a first row and wherein said the elements in said second group area arranged in a second row and wherein said rows are adjacent one another.

3. The cutter of claim 2 wherein said first and second groups of polycrystalline diamond have substantially the same wear ratio and wherein said first group and said second group have different thicknesses thereby wearing the elements in said second group at a different rate than those in said first group responsive to bit rotation.

4. The cutter of claim 2 wherein said first and second groups of polycrystalline diamond have substantially the same thicknesses and wherein said first and second groups have different wear ratios thereby wearing the elements in said second group at a different rate than those in said first group responsive to bit rotation.

5. The cutter of claim 1 wherein said elements in said first group are arranged in a first layer and said elements in said second group are arranged in a second layer adjacent said first layer, said first layer element end surfaces comprising said cutting surface.

6. The cutter of claim 5 wherein said first and second groups of polycrystalline diamond have substantially the same wear ratio and wherein said first group and said second group have different thicknesses thereby wearing the elements in said second group at a different rate than those in said first group responsive to bit rotation.

7. The cutter of claim 5 wherein said first and second groups of polycrystalline diamond have substantially the same thicknesses and wherein said first and second groups have different wear ratios thereby wearing the elements in said second group at a different rate than those in said first group responsive to bit rotation.

8. The cutter of claim 1 wherein said cutting face is substantially planar.

9. The cutter of claim 1 wherein said exposed end surfaces each have a substantially square boundary.

10. The cutter of claim 1 wherein said exposed end surfaces each have a substantially triangular boundary.

11. The cutter of claim 1 wherein said exposed end surfaces each have a substantially irregular boundary.

12. The cutter of claim 1 wherein the cutting elements in said first and second groups are randomly distributed.

13. A diamond cutter in a rotating drag bit comprising:

a plurality of thermally stable, prefabricated polycrystalline diamond synthetic elements each having at least one end surface;

a cutting slug formed of matrix material, said plurality of elements disposed within said cutting slug and said matrix material filling between said plurality of elements;

a cutting face formed on said cutting slug and defined by a plurality of said end surfaces exposed on said cutting face; and a cutting edge formed on one side of said cutting face and including side surfaces presented by said polycrystalline diamond elements, said cutting edge including elements which wear at different rates thereby forming a cutting edge having a profile dependent upon the wear rate of the elements comprising said cutting edge.

14. The diamond cutter of claim 13 wherein said elements are selected from a first group having a first wear rate and from a second group having a second wear rate, said elements selected from said first group being arranged in a first row and said elements selected from said second group being arranged in a second row and wherein said rows are oriented substantially normal to said cutting edge.

15. The diamond cutter of claim 14 wherein said first and second groups of polycrystalline diamond have substantially the same wear ratio and wherein said first group and said second group have different thicknesses thereby wearing the elements in said second group at a different rate than those in said first group responsive to bit rotation.

16. The diamond cutter of claim 14 wherein said first and second groups of polycrystalline diamond have substantially the same thicknesses and wherein said first and second groups have different wear ratios thereby wearing the elements in said second group at a different rate than those in said first group responsive to bit rotation.

17. The diamond cutter of claim 13 wherein said elements are selected from a first group having a first wear rate and from a second group having a second wear rate, said elements selected from said first group being arranged in a first layer and said elements selected from said second group being arranged in a second layer adjacent said first layer, said first layer element end surfaces comprising said cutting face.

18. The diamond cutter of claim 17 wherein said first and second groups of polycrystalline diamond have substantially the same wear ratio and wherein said first group and said second group have different thicknesses thereby wearing the elements in said second group at a different rate than those in said first group responsive to bit rotation.

19. The diamond cutter of claim 17 wherein said first and second groups of polycrystalline diamond have substantially the same thicknesses and wherein said first and second groups have different wear ratios thereby wearing the elements in said second group at a different rate than those in said first group responsive to bit rotation.

20. The diamond cutter of claim 13 wherein said cutting face is substantially planar.

21. The diamond cutter of claim 13 wherein said exposed end surfaces each have a substantially square boundary.

22. The diamond cutter of claim 13 wherein said exposed end surfaces each have a substantially triangular boundary.

23. The diamond cutter of claim 13 wherein said exposed end surfaces each have a substantially irregular boundary.

24. The diamond cutter of claim 13 wherein the cutting elements in said first and second groups are randomly distributed.

25. A rotating drag bit comprising:

a plurality of cutters, including at least two cutters of the type made from cutting elements embedded in a matrix material and presenting a plurality of end surfaces which define a cutting face;

a first one of such cutters having elements which wear at a first rate; and a second one of such cutters having cutting elements which wear at a second rate different from said first rate.

26. The drag bit of claim 25 wherein said cutters are arranged in blades and wherein the cutters in one of said blades are of the type which wear at said first rate and the cutters in another of said blades are of the type which wear at said second rate.

27. The drag bit of claim 26 wherein said drag bit comprises four blades arranged at 90° intervals and wherein the cutters in adjacent blades have cutters which wear at different rates.

28. The drag bit of claim 25 wherein the cutting elements on said first and second cutters have substantially the same wear ratio and wherein the cutting elements on said first cutter have a different thickness from the cutting elements on said second cutter thereby wearing the elements in said second cutter at a different rate than those in said first cutter responsive to bit rotation.

29. The drag bit of claim 25 wherein the cutting elements on said first and second cutters have substantially the same thickness and wherein the cutting elements on said first cutter have a different wear ratio from the cutting elements on said second cutter thereby wearing the elements in said second cutter at a different rate than those in said first cutter responsive to bit rotation.

30. A method of precussive drilling comprising the steps of:

bonding a first layer of cutting elements to a precussive drill bit;

bonding a second layer of such elements to said first layer;

operating the precussive drill bit;

orienting the bit to effect repeated striking of the cutting elements against an earth formation in a manner which compresses the cutting elements each time it strikes the formation.

31. The method of claim 30 wherein the step of orienting the bit to effect repeated striking of the cutting element against an earth formation in a manner which compresses the cutting element each time it strikes the formation comprises the step of orienting the bit to strike the second layer of such elements against the earth formation.

32. The method of claim 30 wherein the step of bonding a second layer of such elements to said first layer comprises the step of offsetting said second layer relative to said first layer.

33. The method of claim 30 wherein said cutting elements comprise polycrystalline cutting elements.

34. A precussive drill bit comprising:

a bit body having a working surface profile of a type suitable for precussive drilling wherein a working surface on said bit body repeatedly strikes an earth formation; and a layer of polycrystalline diamond bonded to said bit body and having a surface which defines substantially all of said working surface.

35. The drill bit of claim 34 wherein said layer of polycrystalline diamond comprises a plurality of cutting elements bonded to said bit body.

36. The drill bit of claim 35 wherein said drill bit further comprises a second layer of polycrystalline diamond cutting elements bonded to said first layer and wherein said working surface is defined on said second layer.

37. The drill bit of claim 36 wherein the cutting elements in said second layer are offset relative to the cutting elements in said first layer.

38. The drill bit of claim 35 wherein some of said cutting elements have different wear ratios.

* * * * *